United States Patent [19]

Worrell

[11] 4,277,875

[45] Jul. 14, 1981

[54] VMP RISER RELEASE TOOL

[75] Inventor: J. Robert Worrell, Tulsa, Okla.

[73] Assignee: Standard Oil Company (Indiana), Chicago, Ill.

[21] Appl. No.: 72,725

[22] Filed: Sep. 4, 1979

[51] Int. Cl.[3] ..... B23P 19/04

[52] U.S. Cl. ..... 29/253; 29/237; 285/39; 294/94

[58] Field of Search ..... 29/253, 234, 237; 285/39, 321; 294/94, 86.25

[56] References Cited

U.S. PATENT DOCUMENTS

| | | | |
|---|---|---|---|
| 526,589 | 9/1894 | Sullivan | 29/253 |
| 4,082,321 | 4/1978 | Nakajima et al. | 285/39 |
| 4,138,148 | 2/1979 | Zaremba | 285/39 |

FOREIGN PATENT DOCUMENTS

| | | | |
|---|---|---|---|
| 31781 | 12/1933 | Netherlands | 29/234 |

*Primary Examiner*—James L. Jones, Jr.
*Attorney, Agent, or Firm*—John D. Gassett

[57] ABSTRACT

A releasing tool for use in disconnecting a casing or conductor pipe cemented below the marine floor from a riser pipe supported from a floating vessel in which the riser pipe and conductor are held together by a snap ring. This includes cam carrier connectable to the lower end of a longitudinal member, such as a drill pipe, and a releasing pin block carrying radially supported releasing pins which are urged inwardly. When the cam of the cam carrier is urged downwardly with respect to the releasing pin block it forces the releasing pins outwardly through ports in the latch pin of the casing to release the split rings from its engaging position.

3 Claims, 5 Drawing Figures

VMP RISER RELEASE TOOL

BACKGROUND OF THE INVENTION

1. Field of Invention

The present invention relates to wells drilled in water-covered areas. It relates especially to a device for releasing a releasable connection between a casing cemented in a hole drilled in the water bottom and a riser pipe which extends from the casing to the water surface.

2. Setting of the Invention

In recent years, there have been a large number of oil and gas wells drilled in water-covered areas. The depth of the water may range from a few feet to a thousand or more. In these cases, the well is drilled in the ocean floor and a casing, which is a steel pipe of large diameter, is set and cemented in the wellbore. Sometimes the wells are completed on the bottom of the ocean floor. By completed, it is meant that the wellhead, or the top, is capped at the ocean floor and arranged with various conduits and valves so that fluid may be produced from the well in a controlled manner. In many cases, however, it is desired to connect a riser pipe (e.g., a large diameter steel pipe) to the well casing in a sealing engagement thereto so, in effect, it extends the well casing to a floating vessel above the water surface.

3. Prior Art

There are many couplings or connectors available for connecting a riser pipe to a subsea wellhead. Perhaps the closest prior art is U.S. Pat. No. 4,138,148, issued Feb. 6, 1979, entitled "Split Ring Riser Latch" issued to Hubart B. Zaremba, assignee, Standard Oil Company (Indiana). The releasing tool disclosed herein is structurally different and operates on a different principle than that of the prior art.

BRIEF DESCRIPTION OF THE INVENTION

This is a releasing device for a sealing releasable connector for the lower end of a marine riser pipe and the upper end of a casing string set in a subsea well. A latch pin is preferably provided on the upper end of the casing (although it might be on the lower end of the riser pipe), and the latch box end is on the lower end of the marine riser pipe. Mating latching grooves are provided on the latch pin and inside the latch box. A latching element, such as a split ring, is provided in these mating grooves and is biased toward the pin. Releasing means operable within the interior of the latch pin forces the latching ring out of the groove on the latch pin and into the groove recess of the latch box.

The releasing means includes a plurality of ports extending through the wall of the pin and into the latching groove. Preferably, the releasing device is a tool connected to the lower end of a drill string and includes a plurality of radially extendable releasing pins which are extended outwardly when the releasing device is in place, or aligned with the ports and the latch pin. Means are provided to align the plurality of radial releasing pins on the releasing tool with the holes in the latch pin. The releasing pins are carried in an annular shaped releasing pin block which is supported from a cam carrier by retaining shafts with the pin block biased downwardly. By overcoming this bias, the cam carrier can be moved toward said releasing pin block. The cam carrier is connected to the drill pipe. The lower end of the cam carrier is shaped to provide a conical cam. The downward movement of the releasing pin annular block is stopped by shoulders on the casing and further downward movement of the drill pipe causes the cam carrier to force the releasing pin blocks outwardly to force the split ring out of locking engagement to the point where the riser pipe can be raised free and clear of the casing.

DRAWINGS

A better understanding of the invention may be had from the following detailed description taken in conjunction with the drawings.

DETAILED DESCRIPTION OF THE INVENTION

Figure 1:
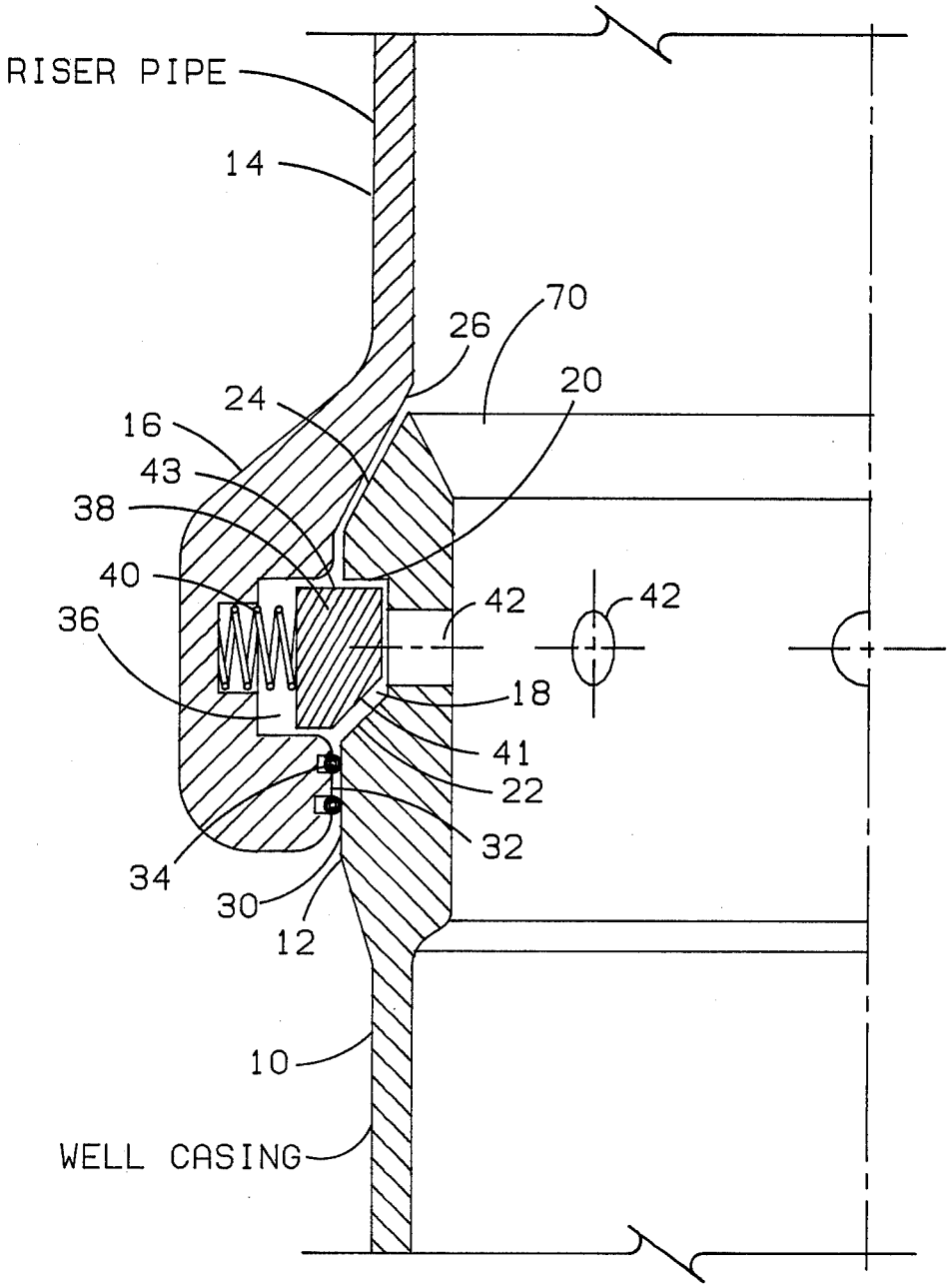
FIG. 1 illustrates the pin end of a subsea casing and the box end of the lower end of a riser pipe.

Attention is first directed to FIG. 1 which shows a well casing 10 having a special latch pin 12 and a riser pipe 14 having a special latch box 16. Pin end 12 has a circumferential latching groove 18 which extends circumferentially around it and has a downward facing upper shoulder 20, and a downwardly sloping shoulder 22. Pin latch 12 also has an upwardly facing shoulder 24 above groove 18.

Latch box 16 of the riser pipe has a downwardly facing shoulder 26 which mates with shoulder 24 of latch pin 12 when riser pipe 14 is in its lowest position. Pin end 12 and latch box 16 can be made separately and welded or otherwise connected to casing 10 and riser pipe 14, respectively, or may be made integral therewith.

Latch pin 12 has a vertical surface 30 which mates with vertical shoulder 32 of latch box 16. Seals 34 are provided between surfaces 30 and 32 to obtain a fluid-tight seal between the well casing 10 and the riser pipe 14. The interior of latch box 16 has a circumferential groove 36 which mates with circumferential groove 18 of latch pin 12 when riser pipe 14 is in its lowermost position against the pin end 12 of the well casing. Mounted within grooves 16 and 18 is a split ring 38, which is urged or biased radially inwardly by spring means 40. Ring 38 has a lower sloping face 41 and an upper face 43 which is perpendicular to the axis of riser pipe 14. When riser pipe 14 is lowered, box 16 drops over pin 12 and pin shoulder 24 acts against ring 38 to force it outwardly. Once ring 38 has cleared shoulder 24, it springs inwardly and extends into pin groove 18. This locks pin 12 in box 16. Seals 34 provide a fluid-tight seal so that riser pipe 14 and casing 10 are effectively connected and sealed.

Also shown in FIG. 1 is a plurality of ports 42 which extend through the wall of latch pin 12 into circumferential groove 18. As will be seen, these are used in the releasing step or disengaging of split ring 38 so that riser pipe 14 can be lifted from casing 10.

Figure 2:
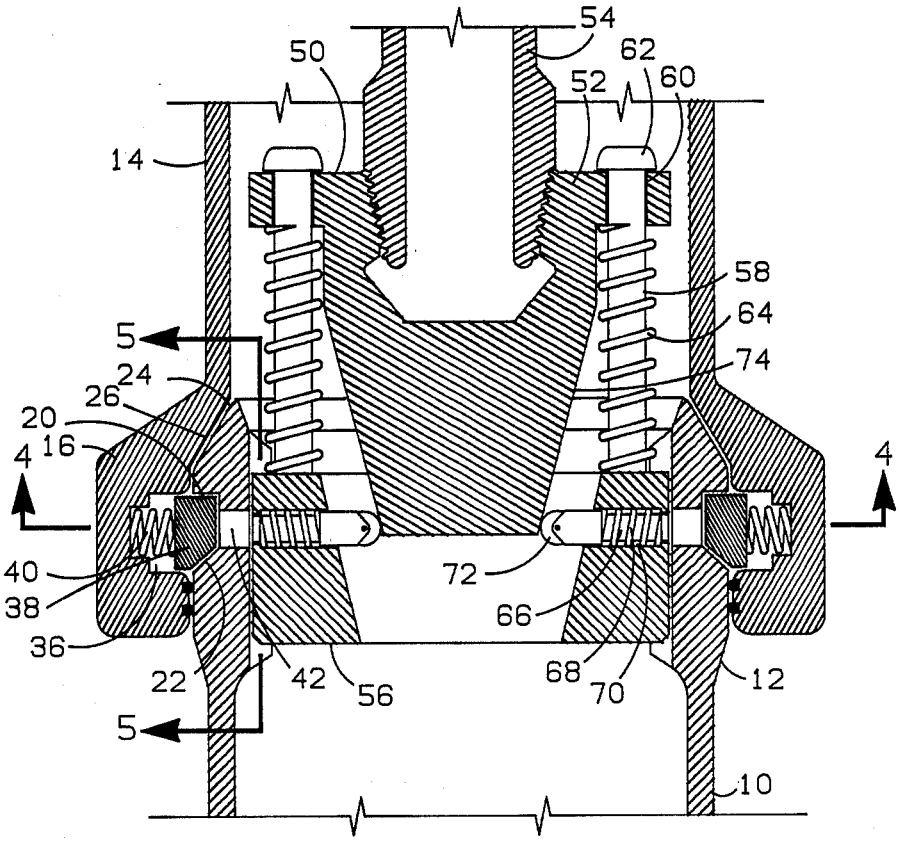
FIG. 2 is similar to FIG. 1 except that a releasing tool is shown in position at the lower end of a drill string within the connected conduits.

Attention is now directed to FIG. 2 which shows releasing tool 50 which includes a cam carrier 52 connectable to the lower end of drill pipe 54. Annular releasing pin block 56 is supported from cam carrier 52 by retaining shaft 58 which slideably extends through holes 60 in cam carrier 52 and are retained there by heads 62. Springs 64 are biased to urge releasing pin block 56 downwardly with respect to cam carrier 52. The lower ends of shaft 58 are fixed to pin block 56.

Figure 4:
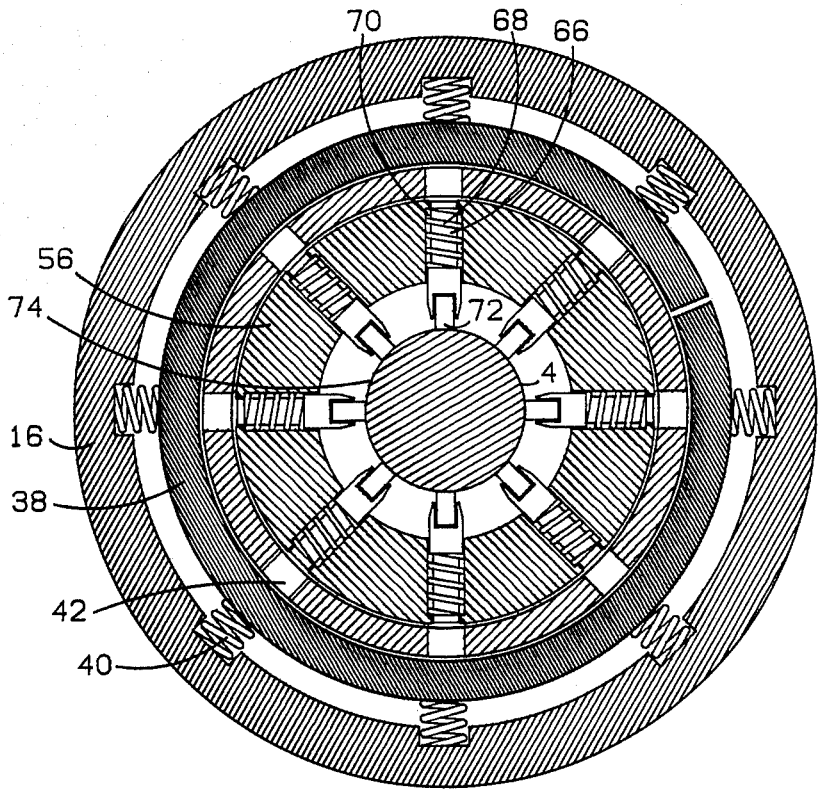
FIG. 4 is a cross-sectional view taken along the line 4—4 of FIG. 2.

As can also be seen in FIG. 4 there is a plurality of releasing pins 66 and biasing springs 68 mounted in horizontal holes 70 of releasing pin block 56. Spring 68 urges releasing pins 66 radially inwardly. Mounted on the inner end of radial releasing pin 66 are rollers 72. The lower end of cam carrier 52 is provided with a conical-like shaped cam 74, which contacts rollers 72 when forced downward.

Figure 5:
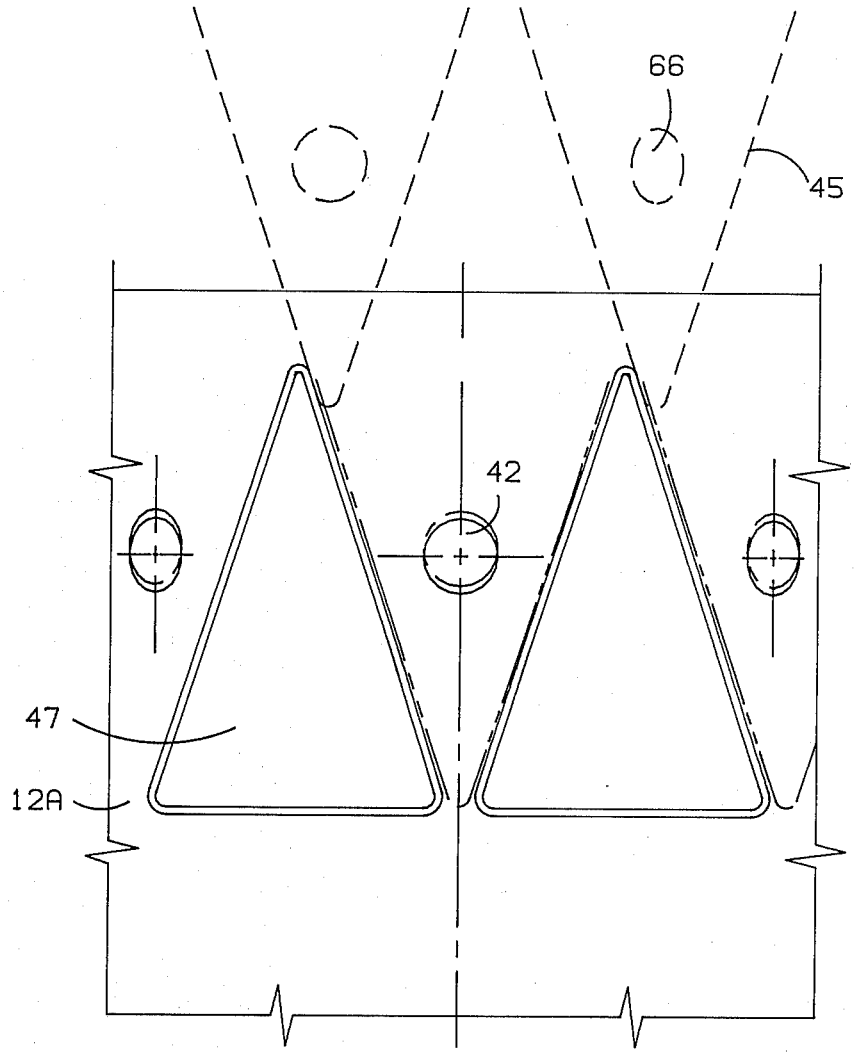
FIG. 5 is a view taken along the line 5—5 of FIG. 2 showing the alignment and seating blocks on the casing and on the releasing tool.

It is important that releasing pins 66 be aligned with ports 42. A means of accomplishing this is shown in FIG. 5. Shown there is the internal surface 12*a* of latch pin 12 having ports 42. Triangularly shaped guiding blocks 47 are shown attached to latch pin 12. Shown in dashed line is a symbolic positioning of orienting blocks 45 on the exterior surface of block 56 and of releasing pins 66. As the drill pipe 54 is lowered, the orienting blocks 45 will contact one of the surfaces of alignment blocks 47 and continue downward movement of the drill pipe forces the orienting blocks 45 into the proper position. Orienting blocks 45 and guiding blocks 47 are so designed and positioned such that when they contact, releasing pins 66 are aligned with ports 42.

Figure 3:
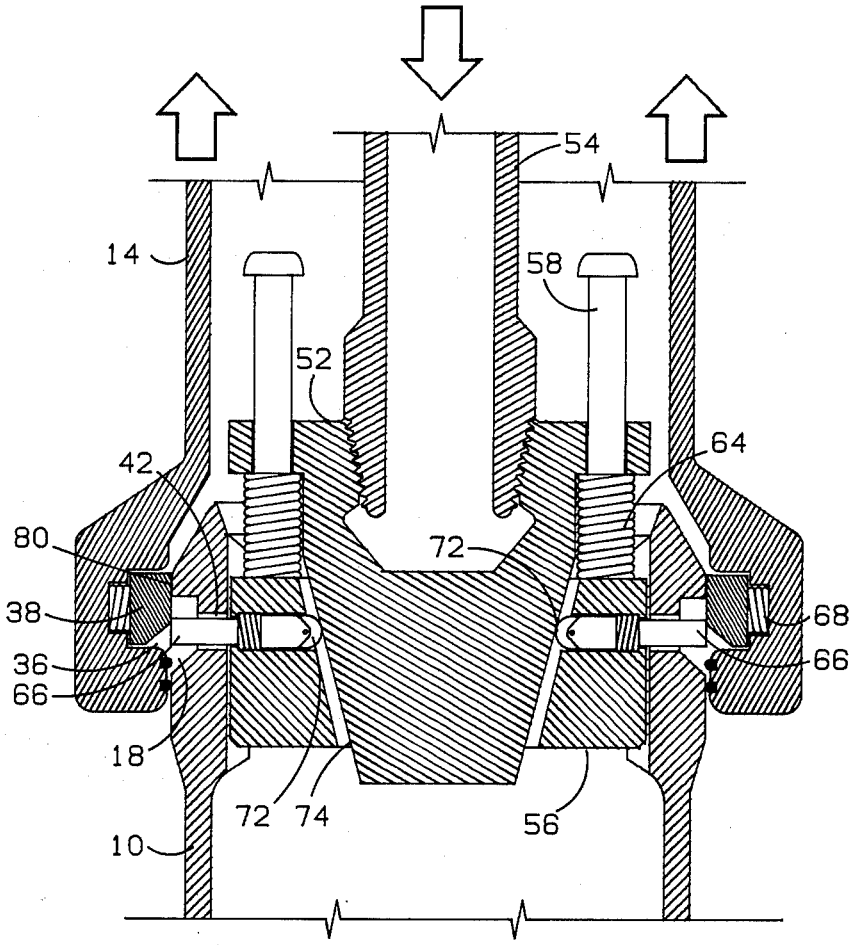
FIG. 3 is similar to FIG. 2 except that the releasing mechanism is shown actuated.

FIG. 3 illustrates the position of the various components when the cam carrier is forced down, driving releasing pins outwardly, which releases the latch box from the latch pin. Shown in FIG. 3 is an expanded split ring 38 which has been forced into groove 36 of the latch box 16 and completely out of pin groove 18 by the extension of releasing rod or pin 66. Releasing rod 66 is forced outwardly by applying downward force on drill string 54, for example, from a floating vessel having a rig on its deck at the surface. As explained above, the releasing pins 66 are aligned with ports 42. When a connector is released as shown in FIG. 3, riser pipe 14 is ready to be stripped up over drill pipe 54. As may be seen in FIG. 3, the split ring 38 clears surface 80 of pin 12. At this point the connector is unlatched. The riser pipe 14 is then pulled to the surface and replaced, repaired, or whatever may be necessary. Then the releasing tool 50 is disconnected from pin 12 merely by raising up on drill pipe 54 and raised to the surface. Springs 64 force the cam carrier 52 upwardly and springs 68 are then freed to retract releasing pins 66. If desired, a repaired or new riser pipe 14 can be lowered over box 12 and the latching means automatically locked. Thus, again, the casing 12 and riser 14 become an integral, fluid-tight conduit.

While the above connectors and release mechanism have been described in detail, various modifications thereof can be made without departing from the spirit or scope of the invention.

What is claimed is:

1. A releasing tool for connecting to the lower end of a string of drill pipe which comprises:

(a) a cam carrier having a longitudinal axis connectable to the lower end of said drill string and having a conical cone section about said axis;

(b) an annular releasing pin block having a plurality of radial holes extending therethrough;

(c) a releasing pin in each said hole with biasing means forcing the inner end of each said pin into the open cylindrical space within said annular releasing pin block;

(d) means to support said annular releasing pin block from said cam carrier including biasing means urging said pin block and said cam carrier longitudinally apart and holding said pin block and said cam such that when said releasing block is moved toward said cam carrier that said cam forces said releasing pins outwardly.

2. A releasing tool as defined in claim 1 in which said element (d) includes:

a retaining shaft slideably mounted in vertical holes spaced about said cam carrier and having a head above said hole and the lower end of said retaining shaft connected to said releasing pin block; and a spring mounted about said retaining shaft urging said cam carrier and said releasing pin blocks apart.

3. A releasing tool as defined in claim 2 including a roller on the inner end of each said releasing pin and spring means biasing said releasing pin inwardly.

* * * * *